US006209207B1

(12) United States Patent
Patterson et al.

(10) Patent No.: US 6,209,207 B1
(45) Date of Patent: Apr. 3, 2001

(54) HANDHELD CANDLE WICK CUTTING DEVICE

(76) Inventors: Shannon L. Patterson; Dennis J. Patterson, both of 190 Conway Rd., South Deerfield, MA (US) 01373; Christopher J. Harris, 4444 Via Marina, #816, Marina Del Rey, CA (US) 90292

( * ) Notice: Subject to any disclaimer, the term of this patent is extended or adjusted under 35 U.S.C. 154(b) by 0 days.

(21) Appl. No.: 09/290,477

(22) Filed: Apr. 12, 1999

(51) Int. Cl.[7] ..... B26B 3/00

(52) U.S. Cl. ..... 30/125; 30/131; 30/279.2; 30/287

(58) Field of Search ..... 30/1, 494, 495, 30/90.1, 109, 110, 111, 112, 113, 120, 123, 124, 126, 125, 127, 131, 240, 279.2, 287, 299, 301

(56) References Cited

U.S. PATENT DOCUMENTS

| | | | | |
|---|---|---|---|---|
| 533,207 | * | 1/1895 | Campbell | 30/110 |
| 853,832 | * | 5/1907 | Ryan | 30/240 X |
| 867,970 | * | 10/1907 | Hedborg | 30/113.1 X |
| 1,089,107 | * | 3/1914 | Blood | 30/112 X |
| 2,894,324 | * | 7/1959 | Hardin | 30/240 |
| 3,964,858 | | 6/1976 | Marik . | |
| 4,131,415 | | 12/1978 | Flinn et al. . | |
| 4,170,860 | | 10/1979 | Flinn et al. . | |
| 4,300,424 | | 11/1981 | Flinn et al. . | |
| 4,844,064 | * | 7/1989 | Thimsen et al. | 30/240 X |
| 4,850,354 | * | 7/1989 | McGurk-Burleson et al. | 30/240 X |
| 4,914,818 | * | 4/1990 | Hall et al. | 30/90.1 |
| 5,353,827 | | 10/1994 | Bouchard et al. . | |
| 5,632,615 | | 5/1997 | DeGarmo . | |

FOREIGN PATENT DOCUMENTS

| | | | | |
|---|---|---|---|---|
| 17559 | * | 12/1881 | (DE) | 30/109 |

* cited by examiner

*Primary Examiner*—Boyer D. Ashley
(74) *Attorney, Agent, or Firm*—Thomas I. Rozsa; Tony D. Chen; Jerry Fong

(57) ABSTRACT

A handheld candle wick cutting device enables an individual to trim the excess long candle wick on any flat-top candles, but especially on candles positioned deep in a narrow candle jar/holder or the like. The wick cutting device includes a main outer tube and an inner tube which has an outer diameter slightly smaller than the inner diameter of the outer tube. The inner tube is rotatably installed within the outer tube and being longer than the outer tube. A pair of cutting blades are mounted to the outer and inner tubes perpendicular to the longitudinal axis, at an operable location to cause a cutting action when one of the tubes is rotated. Each blade has an off-center cutting aperture which when superimposed create a through opening in the cutting device, where a candle wick may be partially inserted therein and perpendicular to the two cutting blades. When one of the two tubes is rotated, the cutting aperture in each blade is caused to close round the candle wick and the edges of the cutting apertures cut the candle wick, where the cut portion of the wick is retained within the inner tube for easy and clean removal and disposal of the cut portion of the wick.

15 Claims, 3 Drawing Sheets

HANDHELD CANDLE WICK CUTTING DEVICE

BACKGROUND OF THE INVENTION

1. Field of the Invention

The present invention relates to the field of portable consumer household products and small tools. More particularly, the present invention relates to the field of cutting tools for trimming an excess long candle wick to a proper recommended length for burning.

2. Description of the Prior Art

Specifically, candles are well known in the art. Candles are often placed in narrow jars Or the like, or they are often free-standing pillar-type with flat tops. Many candle manufacturers recommend keeping the candle's wick trimmed to a ¼" in length for proper burning. One of the problems of keeping the wick trimmed is that the wick is positioned deep in a narrow candle jar/holder or the like making it impossible for conventional scissors or the like to trim off the excess long wick from the candle. Another problem is that when using conventional scissors to trim the wick, it inevitably leaves the user with blackened hands caused by contacting burn residue on the candle holder sides and rim. Still another problem is that when the excess long wick is trimmed, it falls on the candle surface where it becomes difficult if not sometimes impossible to remove from the candle. Still another problem even with other free standing and flat top candles is the difficulty from a measuring standpoint a user encounters in trimming wicks to the recommended length, often ¼".

The following six (6) prior art patents are found to be pertinent to the field of the present invention:

1. U.S. Pat. No. 3,964,858 issued to Marik on Jun. 22, 1976 for "Automatic Candle-Wicking Machine" (hereafter the "Marik Patent");
2. U.S. Pat. No. 4,131,415 issued to Flinn et al. on Dec. 26, 1978 for "Candle Manufacturing System And Method" (hereafter the "'415 Flinn Patent");
3. U.S. Pat. No. 4,170,860 issued to Flinn et al. on Oct. 16, 1979 for "Candle Manufacturing System And Method" (hereafter the "'860 Flinn Patent");
4. U.S. Pat. No. 4,300,424 issued to Flinn et al. on Nov. 17, 1981 for "Candle Manufacturing System Including Wick Cutting Means" (hereafter the "Patent");
5. U.S. Pat. No. 5,353,827 issued to Bouchard et al. on Oct. 11, 1994 for "Process For Producing Pasty Paraffin" (hereafter the "Bouchard Patent"); and
6. U.S. Pat. No. 5,632,615 issued to DeGarmo on May 27, 1997 for "Cookie Cutter Candle" (hereafter the "DeGarmo Patent").

The Marik Patent discloses an automatic candle-wicking machine. The machine automatically inserts a candle wick into a candle after the candle has been formed to its desired shape. A plurality of candles can be wicked at the same time. Specifically, wicking material is cut to length, and then engaged near one end with a wicking rod that is forced down into the candle carrying the wicking material with it and placing the wicking material into the candle on removal of the wicking rod.

The '415 Flinn Patent discloses a candle manufacturing system and method for the production of dipped taper candles. The system includes an overhead conveyor which supports mobile carrier racks for formation of the candles in suspended relation from the rack, a wicking station for providing rows of candle wicks, a dipping station for automatically dipping the wicks on the rack through a predetermined number of dipping cycles, a cutoff station for cutting off the bases, a butt forming station for heat forming the cut butt ends of the candles suspended from the carrier rack, and a cut down station for cutting down the carrier rack rows of the candles formed on the candle wicks.

The '860 Flinn Patent discloses a candle manufacturing system and method, which is the same as the '415 Flinn Patent.

The '424 Flinn Patent discloses a candle manufacturing system which includes a wick cutting means. The wick cutting means includes a pair of rotational blades which automatically cuts the wicks to a preselected length relative to the length of the candle.

The Bouchard Patent discloses an apparatus and method for producing pasty paraffin from liquid paraffin. The method utilizes an agitator for mixing the paraffin during its solidification within a receptacle. The viscosity of the paraffin is controlled by monitoring the power of a motor which drives the agitator. The apparatus is provided for producing candles in bottles from the pasty paraffin produced. The apparatus comprises a filling head which receives the pasty paraffin, a continuous wick, and a positioning device for positioning in a ferrule on the wick with the filling head being-adapted for lowering into the bottle for positioning the ferrule at the bottom and being also adapted to inject pasty paraffin in the bottle for setting the ferrule.

The DeGarmo Patent discloses a cookie cutter candle. It comprises a decorative candle which includes an outer wax layer, at least one specifically shaped wax inlay, a wax plug, an inner wax filler, and a substantially rigid wick.

None of these prior art patents have disclosed a manual handheld candle wick cutting device for individual users to manually and consistently trim wicks to the recommended length, often ¼". It is desirable to provide a handheld candle wick cutting device with the capability of consistently trimming a wick from a candle to a preselected recommended length, often ¼", from the upper surface of the candle. It is also desirable to provide a handheld candle wick cutting device to ensure a clean cutting operation.

SUMMARY OF THE INVENTION

The present invention is a handheld candle wick cutting device which enables an individual to trim the excess long candle wick on any flat-top candle, but especially on candles positioned deep in a narrow candle jar/holder or the like.

The wick cutting device includes a main outer tube and an inner tube which has an outer diameter slightly smaller than the inner diameter of the outer tube. The inner tube is rotatably installed within the outer tube and being longer than the outer tube. A pair of cutting blades are mounted to the outer and inner tubes perpendicular to the longitudinal axis, at an operable location to cause a cutting action when one of the tubes is rotated.

Each blade has a cutting aperture which when superimposed create a through opening in the cutting device, where a candle wick may be partially inserted therein and perpendicular to the two cutting blades. When one of the two tubes is rotated, the cutting aperture in each blade is caused to close round the candle wick and the edges of the cutting apertures cut the candle wick.

It is an object of the present invention to provide a handheld candle wick cutting device which has an outer member and an inner member rotatably installed within the outer member, where each member has a cutting blade such that when one of the two members is rotated causing a cutting action to cut a candle wick.

It is also an object of the present invention to provide a handheld candle wick cutting device that reliably and consistently cuts a candle wick to a proper length.

It is an additional object of the present invention to provide a handheld candle wick cutting device which is user friendly.

It is a further object of the present invention to provide a handheld candle wick cutting device which ensures a clean cutting operation at all times.

It is still a further object of the present invention to provide a handheld candle wick cutting device that is simple and inexpensive to manufacture.

It is also an object of the present invention to provide the user a reliable way to capture a wick trimming during the cutting process to allow easy and clean removal/disposal.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Described briefly, the present invention is a handheld candle wick cutting device which has cutting blades at an operable location for cutting off an excess long wick from a candle to a preselected length.

Figure 1:
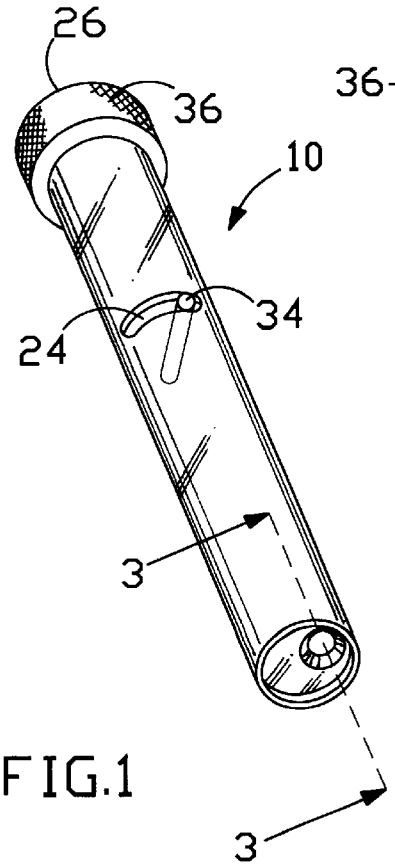
FIG. 1 is a perspective view of one embodiment of the present invention handheld wick cutting device.
Figure 2:
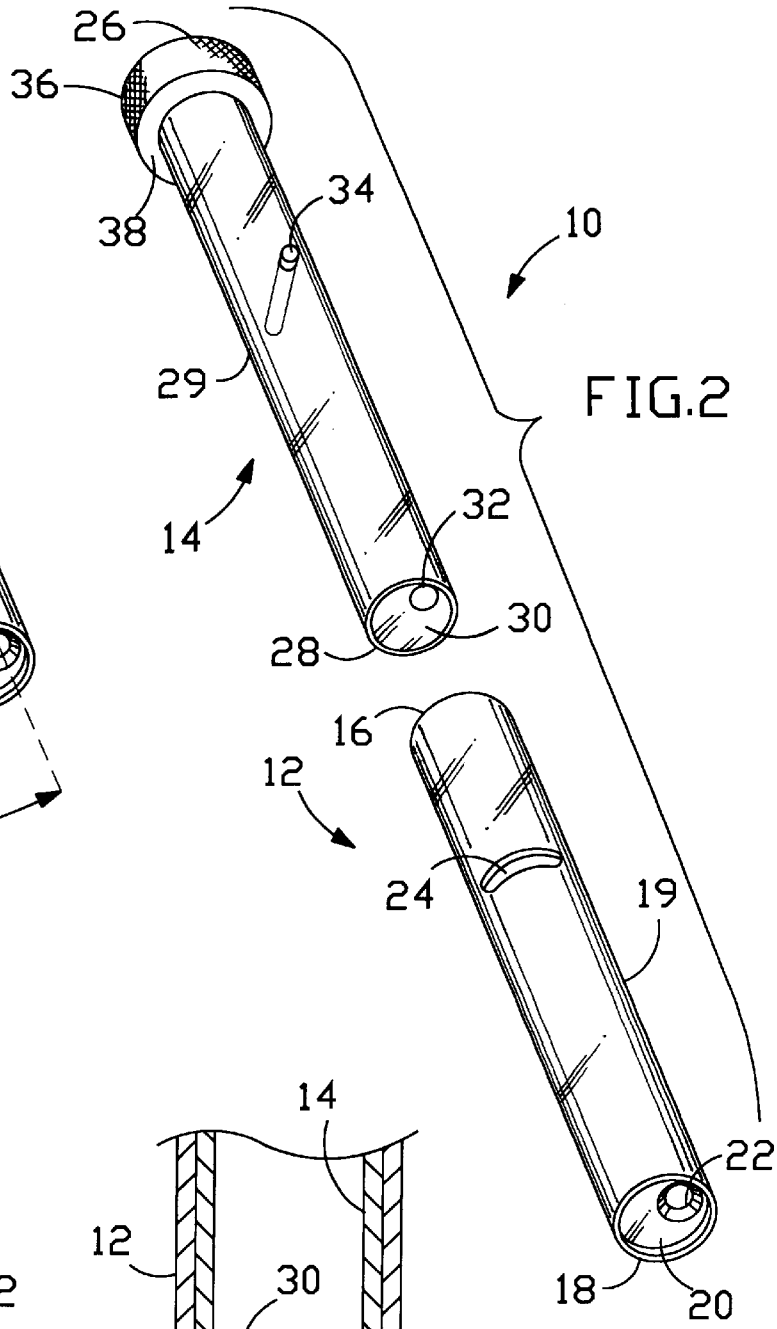
FIG. 2 is an exploded view of the present invention handheld wick cutting device shown in FIG. 1.

Referring to FIGS. 1 and 2, there is shown at 10 the present invention handheld candle wick cutting device which is transparent. The cutting device 10 includes an elongated main outer tubular member 12 and an elongated inner tubular member 14. The outer tubular member 12 has a top or distal end 16, a bottom or proximal end 18 and a circumferential sidewall 19. The circumferential sidewall 19 has a transverse guide slot 24 located at the uppermost portion of the outer tubular member 12. A cutting blade disc 20 is provided with the outer tubular member 12 and mounted to the interior surface of the circumferential sidewall 19 by conventional means, such as glue or adhesive means or any other suitable means known to one skilled in the art, and is located at the lowermost portion of the outer tubular member 12 and adjacent to the bottom end 18, where a predetermined distance "D" is formed from the bottom of the cutting disc 20 to the bottom end 18 of the outer member 12. The predetermined distance is approximately ¼ inch. The cutting blade disc 20 has an off-center cutting aperture 22 extending therethrough and countersunk.

The inner tubular member 14 has a top or distal end 26, a bottom or proximal end 28 and a circumferential sidewall 29. The top end 26 has a gripping knob 36 to provide a gripping means for rotating the inner tubular member 14. The circumferential sidewall 29 has a protruding guide pin 34 located at the uppermost portion of the inner tubular member 14. A cutting blade disc 30 is provided with the inner tubular member 14 and mounted to the interior surface of the circumferential sidewall 29 by conventional means, such as glue or adhesive means or any other suitable means known to one skilled in the art, and is flush with the bottom end 28 of the inner tubular member 14. The cutting blade 30 has an off-center cutting aperture 32 extending therethrough.

The outer tubular member 12 has an inner diameter which is slightly larger than the outer diameter of the inner tubular member 14 so that the inner tubular member 14 is slidable installed within the outer tubular member 12, where the protruding guide pin 34 is positioned and located within the transverse guide slot 24. The top end 16 of the outer tubular member 12 abuts against a shoulder ledge 38 of the gripping knob 36. The protruding guide pin 34 and the transverse guide slot 24 provide a locking mechanism for keeping the inner and outer tubular members 14 and 12 from being separated and lost. The locking mechanism further functions as guide and stop means for preventing over rotating of the tubular members.

Figure 3:
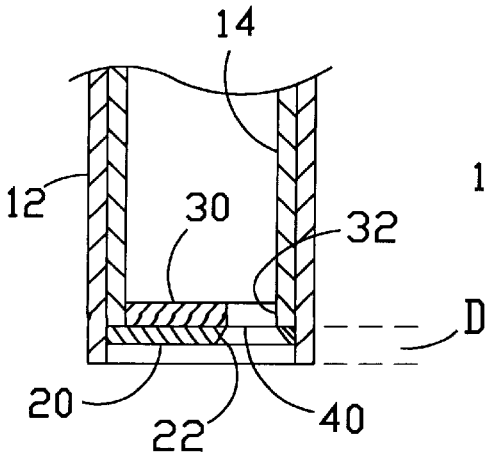
FIG. 3 is a cross-sectional view taken along line 3—3 of FIG. 1.
Figure 4:
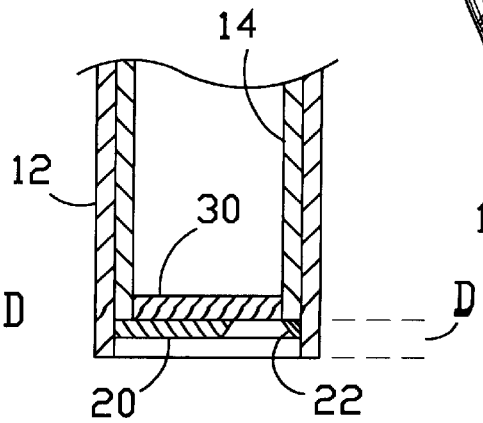
FIG. 4 is a cross-sectional of the present invention handheld wick cutting device, showing the two cutting apertures of the two cutting blades at opposite locations of one another.

Referring to FIGS. 3 and 4, when the two tubular members 12 and 14 are installed together, the two cutting blades 20 and 30 are perpendicular to the longitudinal axis of the cutting device 10 and located adjacent to each other at an operable location to cause a cutting action when one of the two tubular members is rotated. The cutting apertures of each blade when superimposed create a through opening 40 (see FIG. 3) in the cutting device 10, where a candle wick can be partially inserted therein and cut. When one of the two tubular members 12 and 14 is rotated, the cutting aperture in each blade is caused to close round the candle wick and the edges of the cutting apertures 22 and 32 cut the candle wick (see FIG. 4). Furthermore, the inner tubular member 14 captures the cut wick portion and allows the cut wick portion to be dumped from the top of the inner tubular member 14 by the user.

By way of example, the outer tubular member 12 has a length which is approximately five (5) inches, an inner diameter which is approximately ⅝ inch, and an outer diameter which is approximately ¾ inch. The inner tubular member 14 has a length which is approximately 5¾ inches, an inner diameter which is approximately ½ inch, and an outer diameter which is approximately ⅝ inch. It will be appreciated that the dimensions described above are merely one illustrative embodiment and can include many other comparable sets of dimensions.

The present invention handheld candle wick cutting device 10 enables a user to trim the excess long candle wick on any flat-top candles, but especially candles positioned deep in a narrow candle jar/holder or the like.

The handheld candle wick cutter 10 can be made from several materials. The manufacturing process which could accommodate the construction of the wick cutter may be injection, thermoform, etc. or other molding process. By way of example, the wick cutting device can be made of glass, wood, ceramics, plastics such as LEXAN®, PLEXIGLAS®, etc., and metals including platinum, gold, silver, pewter, iron, tin, aluminum, steel, brass and copper.

Figures 5, 6:
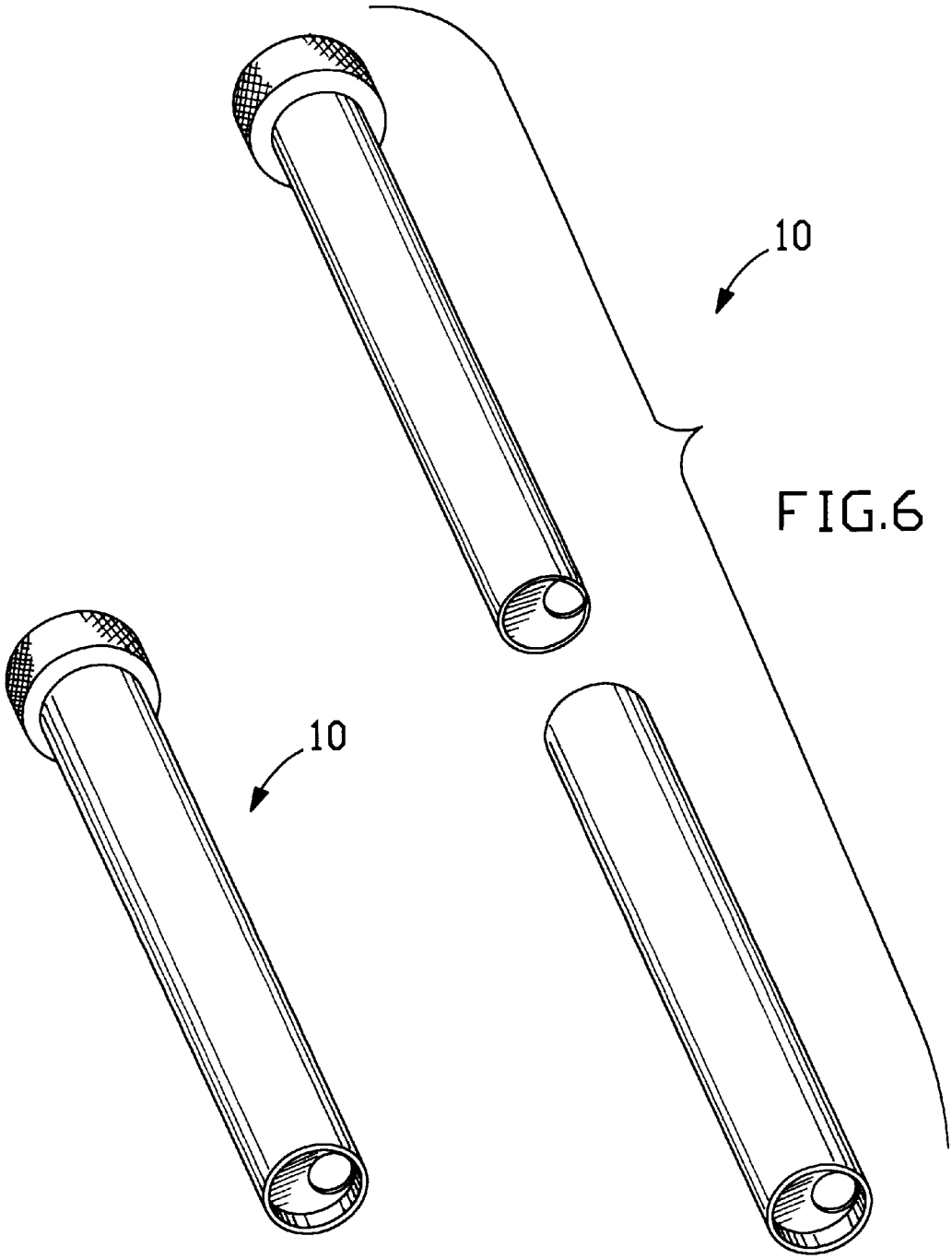
FIG. 5 is a perspective view of another embodiment of the present invention handheld wick cutting device.
FIG. 6 is an exploded view of the present invention handheld wick cutting device shown in FIG. 5.

It will be appreciated that the present invention cutting device 10 can be manufactured with or within the locking mechanism (protruding guide pin 34 and transverse guide slot 24) as shown in FIGS. 5 and 6. The wick cutting device 10 functions the same with or without the locking mechanism. The guide pin 34 may be spring loaded to allow the two tubular members 12 and 14 to be separated if need be for replacement of the cutting blades or for blade sharpening. Alternatively, the guide pin 34 may be screwed into the inner tubular member 14 to allow unscrewing when the two tubular members need to be separated.

Referring to FIGS. 7, 8, 9, and 10, there is shown at 110 a second embodiment of the present invention handheld candle wick cutting device which is very similar to the first embodiment just discussed and the only difference is the nature and configuration of the cutting means. All of the parts of the second embodiment handheld candle wick cutting device 110 are numbered correspondingly with 100 added to each number.

Figure 7:
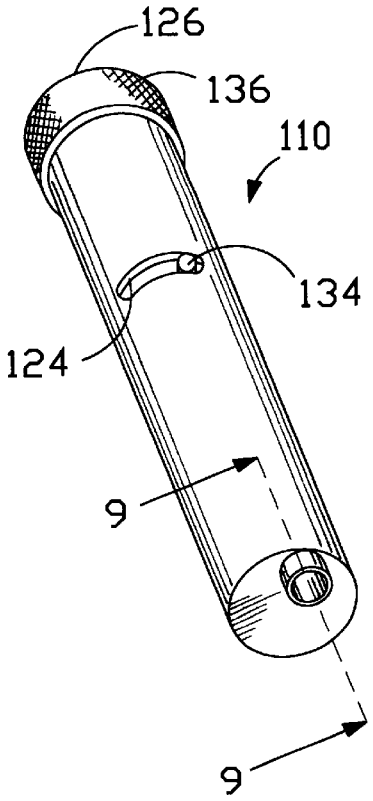
FIG. 7 is a perspective view of still another embodiment of the present invention handheld wick cutting device.
Figure 8:
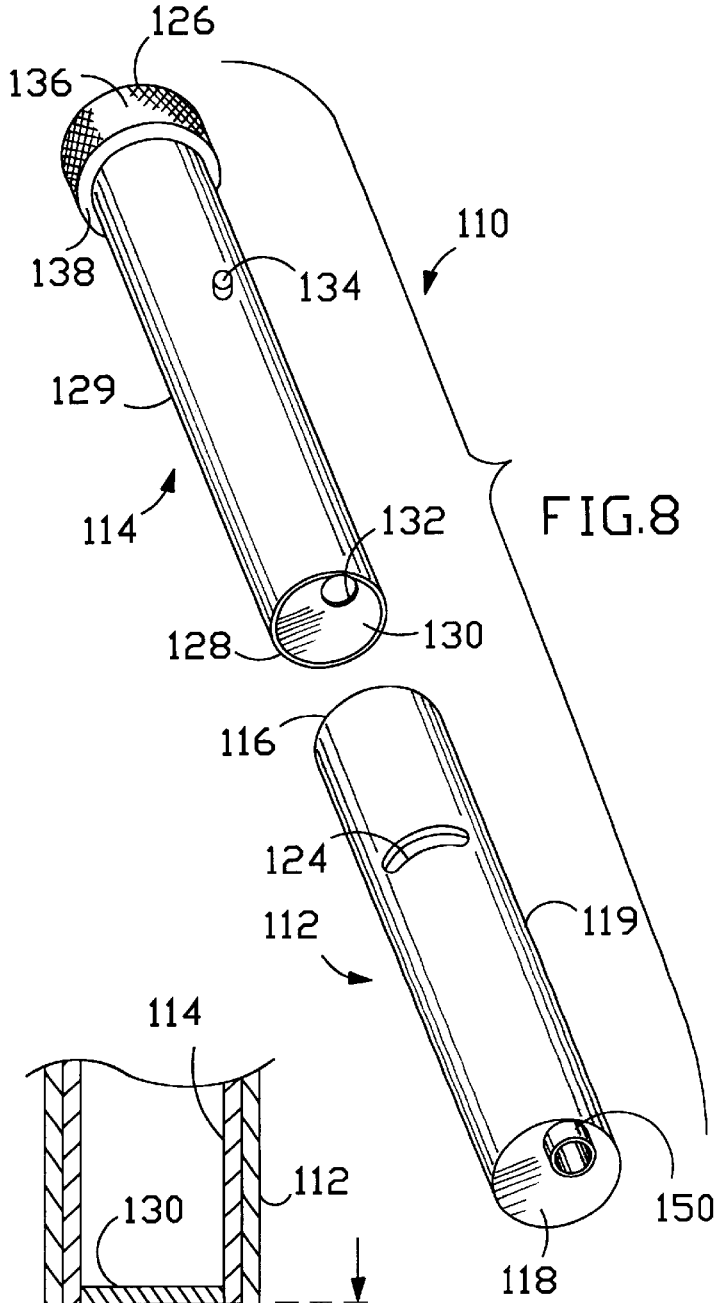
FIG. 8 is an exploded view of the present invention handheld wick cutting device shown in FIG. 7.

Referring to FIGS. 7 and 8, the cutting device 110 includes an elongated main outer tubular member 112 and an elongated inner tubular member 114. The outer tubular member 112 has a top or distal end 116, a closed bottom or proximal end 118 and a circumferential sidewall 119. The circumferential sidewall 119 has a transverse guide slot 124 located at the uppermost portion of the outer tubular member 112. The closed bottom end 118 has a hollow protruding wick insertion structure 150 which is integrally connected thereto and communicates with the interior of the outer tubular member 112. The insertion structure 150 is located off-center of the bottom end 118. The height or predetermined distance "$D_1$" of the protruding wick insertion structure 150 is approximately ¼ inch (see FIGS. 9 and 10).

The inner tubular member 114 has a top or distal end 126, a bottom or proximal end 128 and a circumferential sidewall 129. The top end 126 has a gripping knob 136 to provide a gripping means for rotating the inner tubular member 114. The circumferential sidewall 129 has a protruding guide pin 134 located at the uppermost portion of the inner tubular member 114. A cutting blade disc 130 is provided with the inner tubular member 114 and mounted to the interior surface of the circumferential sidewall 129 by conventional means, such as glue or adhesive means or any other suitable means known to one skilled in the art, and is flush with the bottom end 128 of the inner tubular member 114. The cutting blade 130 has an offcenter cutting aperture 132 extending therethrough.

The outer tubular member 112 has an inner diameter which is slightly larger than the outer diameter of the inner tubular member 114 so that the inner tubular member 114 is slidable installed within the outer tubular member 112, where the protruding guide pin 134 is positioned and located within the transverse guide slot 124. The top end 116 of the outer tubular member 112 abuts against a shoulder ledge 138 of the gripping knob 136. The protruding guide pin 134 and the transverse guide slot 124 provide a locking mechanism for keeping the inner and outer tubular members 114 and 112 from being separated and lost. The locking mechanism further functions as guide and stop means for preventing over rotating of the tubular members.

Figure 9:
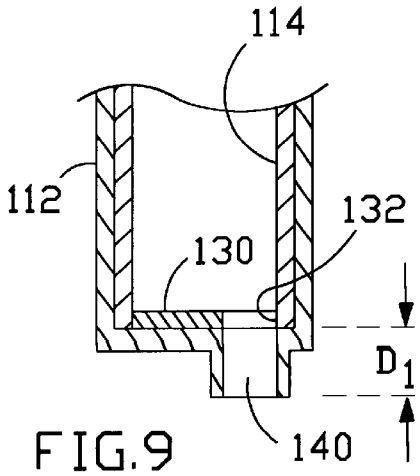
FIG. 9 is a cross-sectional view taken along line 9—9 of FIG. 7.
Figure 10:
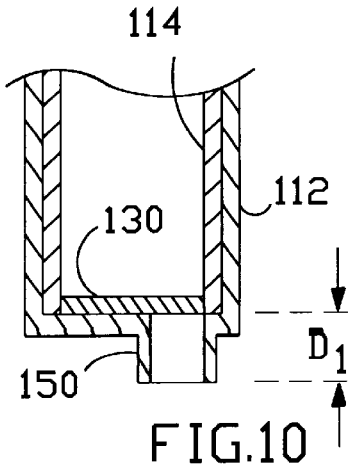
FIG. 10 is a cross-sectional of the present invention handheld wick cutting device shown in FIG. 7, showing the two cutting apertures of the two cutting blades at opposite locations of one another.

Referring to FIGS. 9 and 10, when the two tubular members 112 and 114 are installed together, the cutting blade disc 130 is parallel to the closed bottom end 118 of the outer tubular member 112 and perpendicular to the longitudinal axis of the cutting device 110 and located adjacent to each other at an operable location to cause a cutting action when one of the two tubular members is rotated. The cutting aperture 132 of the blade disc 130 and the hollow protruding wick insertion structure 150 when superimposed create a through opening 140 (see FIG. 9) in the cutting device 110, where a candle wick can be partially inserted therein and cut. When one of the two tubular members 112 and 114 is rotated, the cutting aperture 132 is caused to close round the candle wick and the edge of the cutting aperture 132 cut the candle wick (see FIG. 10).

By way of example, the outer tubular member 112 has a length which is approximately 5¼ inches, an inner diameter which is approximately ⅝ inch, and an outer diameter which is approximately ¾ inch. The inner tubular member 114 has a length which is approximately 5¾ inches, an inner diameter which is approximately ½ inch, and an outer diameter which is approximately ⅝ inch. It will be appreciated that the dimensions described above are merely one illustrative embodiment and can include many other comparable sets of dimensions.

The present invention handheld candle wick cutting device 110 enables an individual to trim the excess long candle wick on any flat-top candles, but especially on candles positioned deep in a narrow candle jar/holder or the like.

It will be appreciated that the present invention cutting device 110 can be manufactured with or without the locking mechanism (protruding guide pin 134 and transverse guide slot 124) as shown in FIGS. 5 and 6. The wick cutting device 110 functions the same with or without the locking mechanism. The guide pin 134 may be spring loaded to allow the two tubular members 112 and 114 to be separated if need be for replacement of the cutting blades or for blade sharpening. Alternatively, the guide pin 134 may be screwed into the inner tubular member 114 to allow unscrewing when the two tubular members need to be separated.

Defined in detail, the present invention is a handheld wick cutting device for cutting off a portion of wick from a candle, the device comprising: (a) an elongated hollow outer tubular member having a distal end and a proximal end; (b) an elongated hollow inner tubular member being longer than the outer tubular member and rotatably installed within the outer tubular member, the inner tubular member having a distal end and a proximal end; (c) a first cutting disc mounted within the outer tubular member and located at a predetermined distance away from the proximal end, the cutting disc having an off-center cutting aperture therethrough; and (d) a second cutting disc mounted within the inner tubular member and flush with the proximal end, the cutting disc having an off-center cutting aperture therethrough such that when the cutting apertures of the first and second cutting disc are superimposed, they form a through opening through which the portion of the wick can be inserted thereto and cut off by rotating one of the inner and outer tubular members; (e) whereby the wick of the candle is inserted into the cutting apertures of the first and second cutting discs such that when one of the inner and outer tubular members is rotated, the portion of the wick of the candle is cut off and retained within the inner tubular member for easy and clean removal and disposal of the cut portion of the wick.

Defined broadly, the present invention is a wick cutting device for cutting off a portion of a wick from a candle, the device comprising: (a) an elongated outer member; (b) an elongated inner member rotatably installed within the outer member; (c) means for forming a closed structure to one of the inner and outer members at a predetermined distance away from one end, the closed structure having an off-center opening therethrough; and (d) cutting means attached within one of the inner and outer members and having an off-center opening therethrough such that when the openings of the cutting means and the closed structure are superimposed, they form a through opening through which the portion of the wick can be inserted thereto and cut off by rotating one of the inner and outer members; (e) whereby the wick of the candle is inserted into the formed opening such that when one of the inner and outer members is rotated, the portion of the wick of the candle is cut off and retained within the inner member for easy and clean removal and disposal of the cut portion of the wick.

Defined more broadly, the present invention is a cutting device, comprising: (a) an elongated outer member; (b) an elongated inner member rotatably installed within the outer member; and (c) at least one cutting means mounted to one of the inner and outer members at an operable location to cause a cutting action when one of the inner and outer members is rotated.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A handheld wick cutting device for trimming off a portion of an excess long wick from a candle, the device comprising:

a. an elongated hollow outer tubular member having a distal end and a proximal end;

b. an elongated hollow inner tubular member being longer than said outer tubular member and rotatably installed within said outer tubular member, the inner tubular member having a distal end and a proximal end;

c. a first cutting disc mounted within said outer tubular member and located at a predetermined distance away from said proximal end, the cutting disc having an off-center cutting aperture therethrough; and d. a second cutting disc mounted within said inner tubular member and flush with said proximal end of said inner tubular member, the second cutting disc having an off-center cutting aperture therethrough such that when the cutting apertures of said first and second cutting discs are superimposed, they form a through opening through which said portion of said excess long wick is inserted into the through opening and cut off by rotating one of said inner and outer tubular members, where a determined length of said excess long wick remains on said candle and corresponds to said predetermined distance, and said portion of said excess long wick that was trimmed off remains within said inner tubular member for easy cleaning and removal and disposal of said portion of said excess long wick.

2. The handheld wick cutting device in accordance with claim 1, further comprising a locking mechanism which includes a transverse guide slot located on the outer tubular member and a protruding guide pin located on the inner tubular member, where the protruding guide pin is installed within the transverse guide slot for maintaining said inner and outer tubular members together.

3. The handheld wick cutting device in accordance with claim 1, wherein said inner and outer tubular members are made of plastic material.

4. The handheld wick cutting device in accordance with claim 1, wherein said inner and outer tubular members are made of metal material.

5. The handheld wick cutting device in accordance with claim 1, wherein said inner and outer tubular members are made of glass material.

6. The handheld wick cutting device in accordance with claim 1, wherein said distal end of said inner tubular member includes a gripping knob for gripping and rotating said inner tubular member.

7. The handheld wick cutting device in accordance with claim 1, wherein said predetermined distance is approximately ¼ inch.

8. A wick cutting device for trimming off a portion of an excess long wick from a candle, the device comprising:

a. an elongated outer member;

b. an elongated inner member rotatably installed within said outer member;

c. means for forming a closed structure to one of said inner and outer members at a predetermined distance away from one end, the closed structure having an off-center opening therethrough; and d. cutting means attached within one of said inner and outer members and having an off-center opening therethrough such that when the openings of the cutting means and the closed structure are superimposed, they form a through opening through which said portion of said excess long wick is inserted into the through opening and cut off by rotating one of said inner and outer members, where a predetermined length of said excess long wick remains on said candle and corresponds to said predetermined distance, and said portion of excess long wick that was trimmed off remains within said inner member for easy cleaning and removal and disposal of said portion of said excess long wick.

9. The wick cutting device in accordance with claim 8, further comprising a locking mechanism which includes a transverse guide slot located on said outer member and a protruding guide pin located on said inner member, where the protruding guide pin is installed within the transverse guide slot for maintaining said inner and outer members together.

10. The wick cutting device in accordance with claim 8, wherein said inner and outer members are made of plastic material.

11. The wick cutting device in accordance with claim 8, wherein said inner and outer members are made of metal material.

12. The wick cutting device in accordance with claim 8, wherein said inner and outer members are made of glass material.

13. The wick cutting device in accordance with claim 8, wherein said inner member includes a gripping knob for gripping and rotating said inner member.

14. The wick cutting device in accordance with claim 8, wherein said predetermined distance is approximately ¼ inch.

15. The wick cutting device in accordance with claim 8, wherein said closed structure is a plate.

* * * * *